United States Patent [19]

Felix

[11] 4,386,494

[45] Jun. 7, 1983

[54] PRODUCTION OF BINDINGS OF FIBER BUNDLES

[75] Inventor: Ernst Felix, Bahnstrasse 35, CH-8610 Uster, Switzerland

[73] Assignees: Ernst Felix; Zellweger Uster Ltd., both of Switzerland

[21] Appl. No.: 271,260

[22] Filed: Jun. 8, 1981

[30] Foreign Application Priority Data

Jul. 23, 1980 [CH] Switzerland ..... 5613/80

[51] Int. Cl.[3] ..... B65H 69/06; D01H 15/00

[52] U.S. Cl. ..... 57/22; 57/261

[58] Field of Search ..... 57/22, 1, 261, 263, 57/301, 302; 242/35.5 R, 35.5 A, 35.6 R, 37 A, 147 A

[56] References Cited

U.S. PATENT DOCUMENTS 3,654,756 4/1972 Artamonova et al. ..... 57/261

4,343,143 8/1982 Baumgartner ..... 57/22

*Primary Examiner*—Donald Watkins

*Attorney, Agent, or Firm*—Antonelli, Terry & Wands

[57] ABSTRACT

A method of and apparatus for binding fiber bundles, as produced in the textile industry. Each of the two fiber bundles is mixed with the other fiber bundle in two regions of the binding and is wound around in a force-locking manner with individual fibers originating from the fiber bundles. The loose ends of the two bundles to be bound are automatically severed during the course of the formation of the binding and the remaining ends are introduced or worked into the binding using a pair of rotatable disc-shaped deformation members which are selectively movable toward one another while rotating to engage the fiber bundles.

15 Claims, 8 Drawing Figures

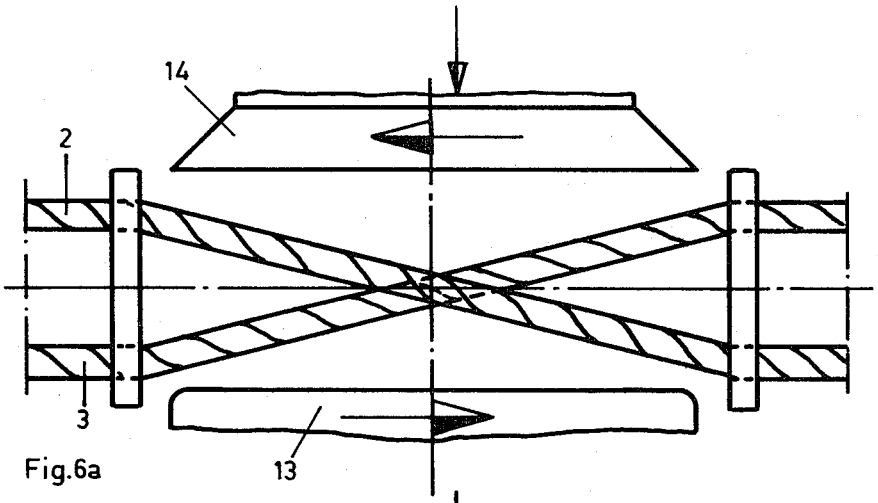
Fig.6a
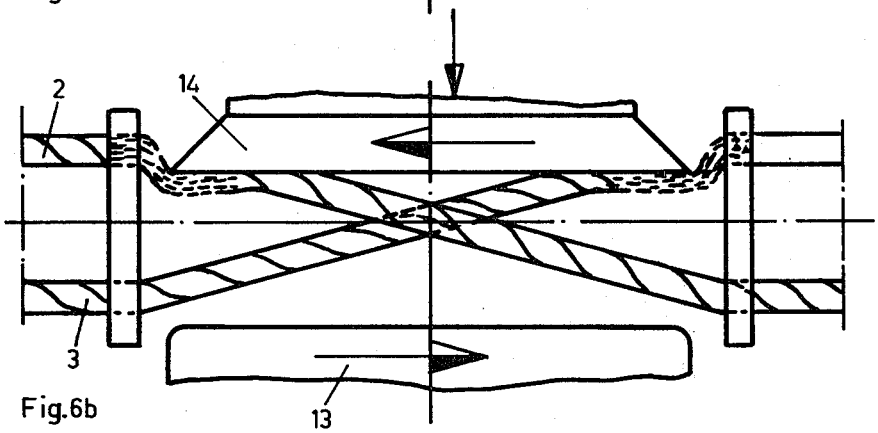
Fig.6b
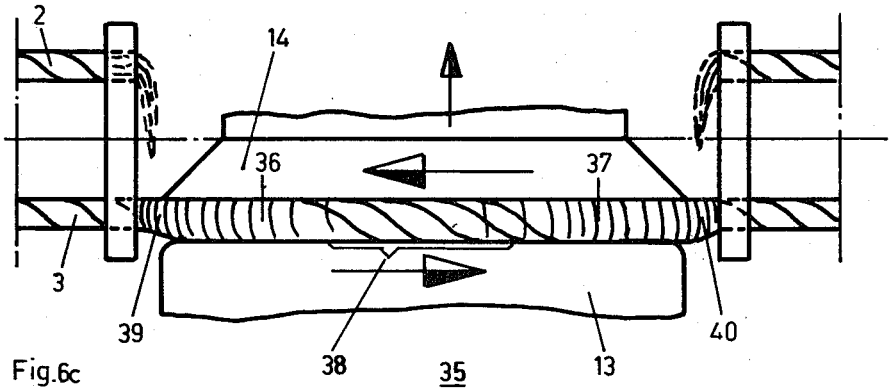
Fig.6c
Fig.6

PRODUCTION OF BINDINGS OF FIBER BUNDLES

FIELD OF THE INVENTION

This invention relates to the production of bindings of fiber bundles. Within the context of the invention, the term "fiber bundle" is to be understood to mean a bundle of fibers, a yarn or a ply yarn, a twine or a similar stretched structure of combined fibers or threads. Both vegetable and/or animal base materials, such as cotton, wool or silk, may be included, as well as synthetic base materials or mixtures of such. The invention relates in particular to the textile industry, but it is not restricted thereto.

BACKGROUND OF THE INVENTION

A problem frequently arises in the manufacturing and processing industries of having to bind individual fiber bundles together. This is the case, for example, in winding or weaving. For a long time, this problem has been solved by tying or knotting the fiber bundles, initially by manual operations, but later also by means of relatively-complicated automatic mechanical tying apparatus.

However, other binding principles have also been used, thus, in particular, the method of splicing yarns. It is known to produce a fiber binding by whirling together two fiber bundles under the effect of a fluid, preferably compressed air. Such a method requires apparatus which is complicated and difficult in use, because, for example, of the necessity to supply compressed air. It is also very often difficult to find optimum operating parameters in particular cases.

BRIEF DESCRIPTION OF THE INVENTION

An object of this invention is to provide a method of and an apparatus for producing reliable bindings of fiber bundles very rapidly and in a simple manner and at low cost.

Accordingly, the invention provides a method for the production of a binding of fiber bundles in which the fiber bundles to be bound together are brought next to each other, shearing forces and tractive and/or compressive forces are then exerted on at least one part of the circumference of each of the fiber bundles to be bound and on all of the fiber bundles by means of physical contact of the bundles using moving deformation members, in order to change the original cross sections and/or the original structure of the fiber bundles to be bound and to detach individual fibers from at least one of the bundles to be bound, at least partly from the bundle thereof, and to displace them such that they finally wind around the fiber bundles to be bound in a force-locking manner at least in one part of the operational region of the deformation members. The bundles which are bound by the winding are then relocated out of the operational region of the deformation members.

To effect this operation, the clamped bundles which are to be bound are conveyed, with a crossed orientation, to the interspace between two deformation members provided with flat profiled surfaces and which move in opposite directions of rotation to each other. The spacing between the profiled surfaces is then temporarily reduced in order to clamp the fiber bundles and to bring them into close contact with both profiled surfaces, the profiled surfaces not contacting each other however, as a result of which, the fiber bundles are bound together approximately over a length corresponding to the expansion of the profiled surfaces in the longitudinal direction of the bundles and the loose end of each fiber bundle is automatically severed therefrom before the binding has been produced.

BRIEF DESCRIPTION OF THE DRAWINGS

The invention will now be described by way of example with reference to the accompanying drawings, in which:

FIGS. 6*a*, 6*b* and 6*c* illustrate the progressive course of the formation of a binding in three phases.

Corresponding parts are given the same reference numbers in all the figures which are not drawn to scale.

DETAILED DESCRIPTION OF THE PREFERRED EMBODIMENTS

Figure 1:
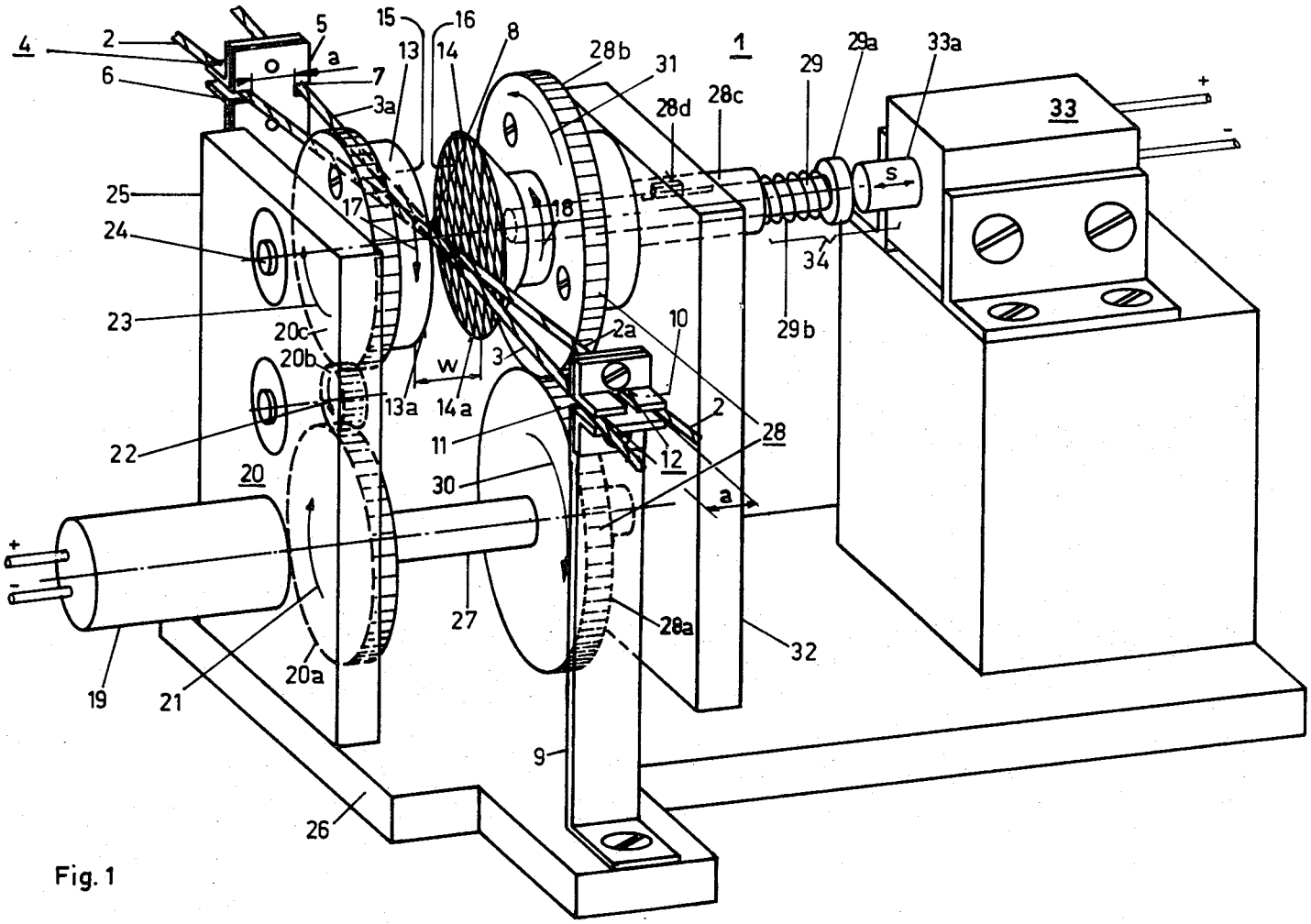
FIG. 1 is a schematic view of one embodiment of a binding apparatus according to the invention.

FIG. 1 illustrates a binding apparatus 1. Two fiber bundles 2 and 3 are held by a first thread clip 4 of a known type, preferably with an adjustable clamping resistance. The fiber bundles 2 and 3 are then guided through a first thread guide 5, which is provided, for example, with slits 6 and 7 for the respective bundles spaced by a distance a. The bundles are then crossed at a crossing point 8 and conveyed to a second thread guide 9 having similar slits 10 and 11 spaced from each other by the distance a. The two bundles 2 and 3 are held under tension outside the second thread guide 9 by another thread clip 12.

The crossing point 8 is located in an interspace between a first deformation member 13 and a second deformation member 14. The deformation members 13 and 14 are discs in this embodiment and the opposite lateral surfaces 15 and 16 of the discs have a structure which is adapted to the character of the fiber bundle. Thus, the surfaces 15 and 16 are not smooth, but have a degree of roughness, which roughness is relatively fine for fine fiber bundles or for fine individual fibers, but is correspondingly coarser for coarse-fibered fiber bundles.

The two deformation discs 13 and 14 rotate in opposite directions, i.e., deformation disc 13 rotates in the direction of arrow 17 and deformation disc 14 rotates in the direction of arrow 18. For this movement, the optimum relative direction of rotation of the deformation discs 13 and 14 depends on whether the fiber bundles 2 and 3 to be bound together have a Z-twist or an S-twist.

The rotation of the deformation disc 13 is effected by a driving motor 19 connected by way of drive shaft 27 to a gear arrangement 20 comprising the gear wheels 20*a*, 20*b* and 20*c*. The directions of rotation of the gear wheels of the gear arrangement 20 are indicated by the arrows 21, 22 and 23, respectively. The shaft 27 is rotably mounted in a bearing block 25.

The gear wheel 20*c* is fixed on a shaft 24 which is rotatably mounted in the bearing block 25 mounted on a base plate 26. The first deformation disc 13 is also fixed on the shaft 24 so as to be rotatable therewith and with the gear wheel 20*c*.

A gear wheel 28*a* of a second intermediate gear arrangement 28 is also fixed on the motor shaft 27, the end of which is rotatably mounted in a second bearing block 32. A second gear wheel 28*b* of this second intermediate gear arrangement 28 is engaged with the gear wheel 28*a*. The direction of rotation of the gear wheels 28*a* and 28*b* is indicated by the arrows 30 and 31. A sleeve 28*c* connected to the gear wheel 28*b* is also rotatably mounted in the second bearing block 32. The sleeve 28*c* transmits the rotational direction imparted to it from the second gear wheel 28*b* to another shaft 29 which is axially slidable in the sleeve 28*c*, relative angular movement therebetween being prevented by, for example, a spline 28*d* engaged in a groove in the shaft 29.

The movable shaft 29 forms part of an actuating mechanism 34 and has an end flange 29*a* on which a spring 29*b* bears to urge the shaft 29 to the right up to a stop (not shown). The shaft 29 is axially movable in the direction "s" by means of a pushing device 33 including, for example, an armature (not shown) operable to displace a plunger 33*a* into engagement with the flange 29*a*. Thus, the second deformation disc 14, being secured to the shaft 29, may also be moved to the left toward the first deformation disc 13 by the axial movement of the shaft 29 to the left under the action of the pushing device 33 and may be returned by the spring 29*b* when the excitation of the armature in the pushing device 33 is terminated.

The second deformation disc 14 is spaced from the first deformation member 13 by a distance "w" while at rest, but may be moved to the left by exciting the pushing device 33 such that the clear width between members 13 and 14 is reduced from a maximum value "$w_{max}$" to a defined minimum value "$w_{min}$". In the present embodiment, this change in position of the deformation disc 14 is effected suddenly.

It should be noted that an edge 14*a* of the second deformation disc 14 facing the first deformation member 13 is relatively rough due to the structure of the surface 16 of the disc 14. In contrast, an edge 13*a* of the first deformation disc 13 is preferably slightly rounded or smoothed although the surface 15 which is opposite the surface 16 is also profiled.

If the pushing device 33 is actuated in a pulsating manner to move the rotating second deformation disc 14 towards the first deformation disc 13 while the discs 13 and 14 are rotating in the opposite directions, and while the fiber bundles 2 and 3 have been crossed and inserted, then the loose ends 2*a* and 3*a* of the fiber bundles 2 and 3 are initially frayed by the rough edge 14*a* of the disc 14 and the parts of the loose ends located outside the edge 14*a* are carried away. The second deformation disc 14 then approaches nearer to the first deformation disc 13 until the clear width "w" between the discs finally reaches its minimum value "$w_{min}$", which preferably approximately just corresponds to the diameter of a fiber bundle 2 or 3. As a result of this, the two fiber bundles 2 and 3 are brought into close contact with each other as well as with the profiled surfaces 15 and 16 of the deformation discs 13 and 14. Under these conditions, the deformation discs 13 and 14 move in opposite directions, but do not touch each other while effecting the binding of the fiber bundles 2 and 3 positioned therebetween.

Figure 2:
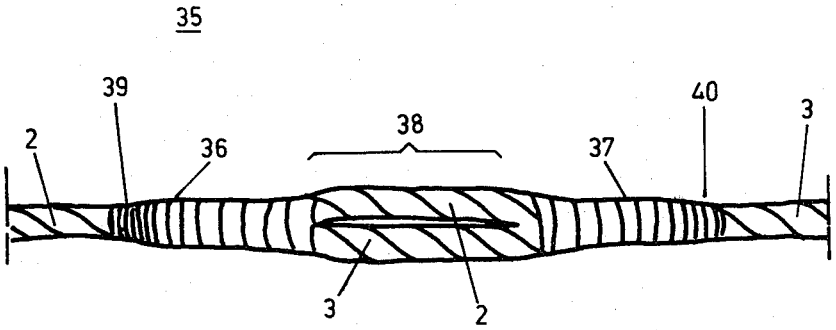
FIG. 2 illustrates a first type of binding.

As a result of the relative speed of opposite points which varies over the diameter of the surfaces 15 and 16 of the rotating discs 13 and 14, a considerable influence on the interlying fiber bundles 2 and 3 is mainly produced in the external regions of these surfaces 15 and 16, so that the individual fibers of the bundles are at least partly intermixed, whereby individual fibers are at least partly detached from their binding and loop or wind around the two fiber bundles 2 and 3 in a force-locking manner. As a result of this, a binding of the two fiber bundles is produced which has approximately the formation schematically illustrated in FIG. 2. The complete binding 35 substantially extends approximately over a length which equals the diameter of the surfaces 15 and 16. A relatively force-locking binding is produced between the fiber bundles 2 and 3 in the two external regions 36 and 37. There is not an actual binding of the two bundles in the center region 38 in which the relative speed of opposite points on the surfaces 15 and 16 is relatively low. The two fiber bundles 2 and 3 are positioned there more or less closely next to each other and are not, or are only very slightly provided with a winding.

The ends of the fiber bundles 2 and 3 which were frayed in the first phase of the approaching movement of the deformation discs 13 and 14 are introduced or worked into the binding 35 in the peripheral regions 39 and 40. During this operation, a continuous transition from the fiber bundle 2 to the binding 35 and from the binding to the fiber bundle 3 is produced.

Figure 3:
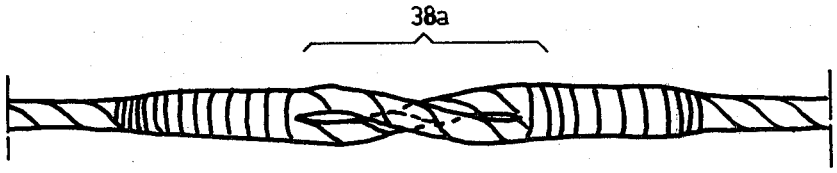
FIG. 3 illustrates a second type of binding.

Depending on the adjustment of the apparatus, a binding of the type illustrated in FIG. 3 may also be produced. In this type of binding, the center region 38*a* is distinguished in that the two fiber bundles are not bound by a deformation of their cross sections nor by a force-locking winding, but they are more or less tightly twisted together.

Figure 4:
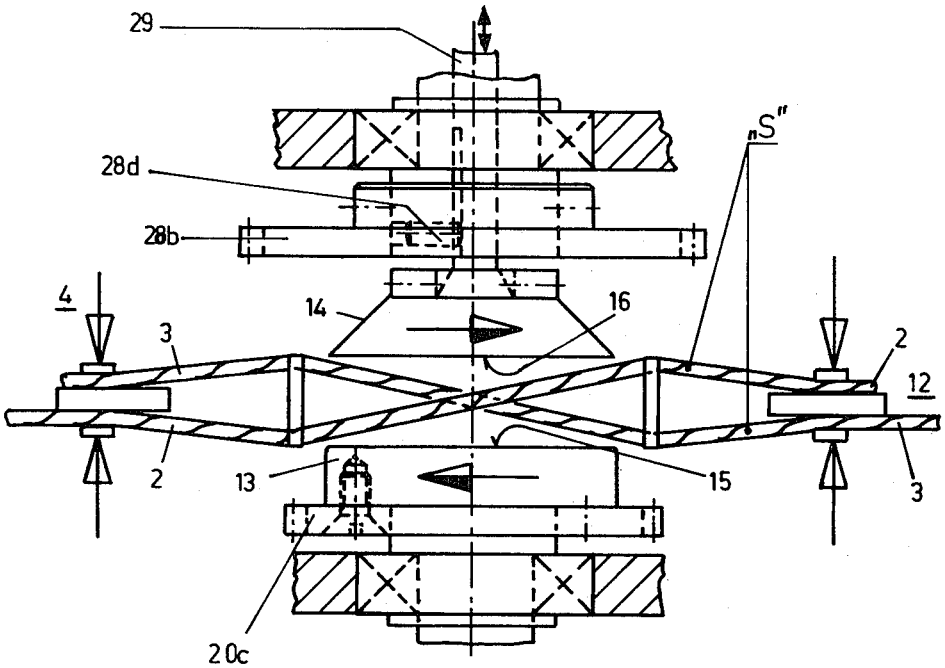
FIG. 4 is a schematic view illustrating a preferred crossing of the fiber bundles in the case of an S-twist.
Figure 5:
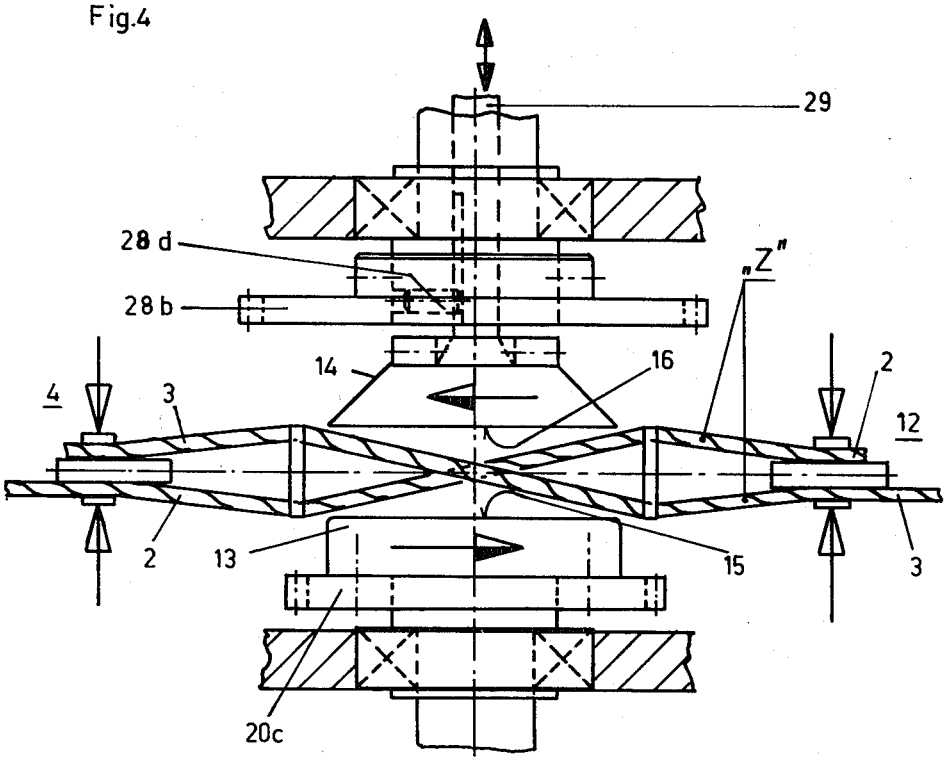
FIG. 5 is a schematic view illustrating a preferred crossing of the fiber bundles in the case of a Z-twist.

FIG. 4 is a schematic view of the preferred crossing of the bundles 2 and 3 and of the rotational direction of the deformation members 13 and 14 which is preferably to be selected in the event that two fiber bundles 2 and 3 are to be bound with an S-twist. FIG. 5 illustrates in an analogous manner the conditions when the fiber bundles 2 and 3 have a Z-twist.

FIGS. 6*a* through 6*c* illustrate the progressive course of the formation of a binding 35 in three phases. In FIG. 6*a*, a crossed insertion of the fiber bundles 2 and 3 between the rotating discs 13 and 14 is effected with the bundles clamped in the thread clips 4 and 12 in the manner shown in FIG. 5. In FIG. 6*b* a fraying severing of the loose ends of the fiber bundles 2 and 3 occurs during the forward movement of the rotating deformation member 14 in response to actuation of the pushing device 33 as the disc 14 approaches the disc 13. In FIG. 6*c* formation of the binding 35 occurs between the deformation members 13 and 14, which are now very close to each other.

As can be seen from the foregoing description, a method and apparatus is provided for producing the binding of fiber bundles is a very rapid and simple manner and at low cost. Thus, as a result of the present invention, the inconvenient and complex procedures of the prior art may clearly be avoided.

While I have shown and described various embodiments in accordance with the present invention, it is understood that the invention is not limited to the details shown and described herein but is susceptible of numerous changes and modifications as known to a person skilled in the art, and I therefore do not wish to be limited to the details shown and described herein but intend to cover all such changes and modifications obvious to those of ordinary skill in the art.

What is claimed is:

1. A method for the production of a binding of fiber bundles comprising the steps of positioning the fiber bundles to be bound together adjacent to each other; applying shearing forces and tractive and/or compressive forces to at least one part of the circumference of each of the fiber bundles to be bound and on all of the fiber bundles by means of physical contact of the bundles using moving deformation members, in order to change the original cross sections and/or the original structure of the fiber bundles to be bound and to detach individual fibers from at least one of the bundles to be bound, at least partly from the bundle thereof and to displace them such that they finally wind around the fiber bundles to be bound in a force-locking manner at least in one part of the operational region of the deformation members; and then relocating the bundles which are bound by the winding out of the operational region of the deformation members; wherein said positioning includes conveying the clamped bundles to be bound while having a crossed orientation to the interspace between two deformation members provided with opposed flat profiled surfaces and which move in opposite directions to each other; said applying of forces being effected by reducing the spacing between the profiled surfaces in order to clamp the fiber bundles between said moving deformation members to bring them into close contact with both profiled surfaces thereof, the profiled surfaces not contacting each other, as a result of which, the fiber bundles are bound together approximately over a length corresponding to the expansion of the profiled surfaces in the longitudinal direction of the bundles.

2. A method for binding fiber bundles according to claim 1, further including the step of severing one end of each of the fiber bundles subsequent to the positioning of the bundles between said profiled surfaces.

3. A method for binding fiber bundles according to claim 1, wherein said deformation members comprise a pair of spaced rotatable discs which are rotated in opposite directions.

4. A method for binding fiber bundles according to claim 1, wherein said step of positioning said fiber bundles includes clamping and guiding all bundles with a crossed orientation along a path which extends between said deformation members.

5. An apparatus for the production of a binding of fiber bundles comprising first and second deformation members positioned in spaced relationship on opposite sides of an operational region and having facing profiled surfaces; drive means for moving said first and second deformation members so that their profiled surfaces move in opposite directions, the spacing between said profiled surfaces of said first and second deformation members being normally greater than the combined diameters of the fiber bundles to be bound; guide means for supporting a plurality of fiber bundles having a crossed orientation in the operational region of said first and second deformation members; and actuating means for selectively effecting relative movement of said first and second deformation members toward one another to reduce the spacing between said profiled surfaces.

6. An apparatus according to claim 5, wherein said first and second deformation members are provided in the form of first and second discs mounted for rotation about an axis transverse to a lateral profiled surface thereof.

7. An apparatus according to claim 6, wherein said drive means comprises means for driving said first and second discs in rotation in opposite directions.

8. An apparatus according to claim 5, wherein said actuating means includes a shaft secured to one of said deformation members so as to be substantially transverse to the profiled surface thereof, support means for supporting said shaft for axially sliding movement, bias means between said shaft and said support means for biasing said shaft to a position providing said normal spacing between said deformation members and moving means for axially sliding said shaft to effect a reduction in the spacing between said deformation members.

9. An apparatus according to claim 8, wherein said first and second deformation members are provided in the form of first and second discs mounted for rotation about an axis transverse to a lateral profiled surface thereof.

10. An apparatus according to claim 9, wherein said drive means comprises means for driving said first and second discs in rotation in opposite directions.

11. An apparatus according to claim 5, wherein said guide means includes first and second thread clips for clamping said fiber bundles at longitudinally-spaced positions along a path which extends through said operational region of said deformation members.

12. An apparatus according to claim 11, wherein said guide means further includes first and second thread guides located adjacent said longitudinally-spaced positions for effecting a cross-over of said fiber bundles in the vicinity of the center of said operational region between the profiled surfaces of said deformation members.

13. An apparatus according to claim 6, wherein the peripheral edge of the profiled surface of one of said deformation members is relatively rough, while the peripheral edge of the profiled surface of the other deformation member is smooth.

14. An apparatus according to claim 9, wherein the peripheral edge of the profiled surface of one of said deformation members is relatively rough, while the peripheral edge of the profiled surface of the other deformation member is smooth.

15. An apparatus comprising first and second deformation members arranged in an axial spaced relationship and positioned between a first thread clip and a first thread guide on one side and a second thread guide and a second thread clip on the other side of said deformation members, said first and second thread clips and said first and second thread guides forming means for effecting the crossed clamping of fiber bundles so that they pass through the space between said first and second deformation members, the opposite lateral surfaces of the deformation members being profiled, drive means for moving said two deformation members so that their profiled surfaces may move in opposite directions in the plane of those surfaces, and actuating means for reducing the spacing between those profiled surfaces by effecting an axial shift of at least one of said deformation members so that said profiled surfaces contact fiber bundles which are clamped in position therebetween.

* * * * *